US012729896B2

(12) United States Patent
Zhang

(10) Patent No.: US 12,729,896 B2
(45) Date of Patent: Sep. 8, 2026

(54) ICE MAKER

(71) Applicant: DONGGUAN HUIHENG INTELLIGENT ELECTRICAL APPLIANCES CO., LTD., Dongguan City (CN)

(72) Inventor: Wusheng Zhang, Gaozhou (CN)

(73) Assignee: DONGGUAN HUIHENG INTELLIGENT ELECTRICAL APPLIANCES CO., LTD., Dongguan City (CN)

( * ) Notice: Subject to any disclaimer, the term of this patent is extended or adjusted under 35 U.S.C. 154(b) by 67 days.

(21) Appl. No.: 18/752,869

(22) Filed: Jun. 25, 2024

(65) Prior Publication Data

US 2025/0244067 A1 Jul. 31, 2025

(30) Foreign Application Priority Data

Jan. 31, 2024 (CN) ..... 202420237850.2

(51) Int. Cl.
*F25C 1/22* (2018.01)
*F25C 5/182* (2018.01)

(52) U.S. Cl.
CPC ..... *F25C 1/22* (2013.01); *F25C 5/182* (2013.01); *F25C 2305/0221* (2021.08); *F25C 2400/14* (2013.01)

(58) Field of Classification Search
CPC .... F25C 1/22; F25C 5/182; F25C 2305/0221; F25C 2400/14; F25C 1/08; F25C 2700/04;
(Continued)

(56) References Cited

U.S. PATENT DOCUMENTS 5,245,841 A * 9/1993 Paul ..... F25D 23/006 62/344
5,419,151 A * 5/1995 Minari ..... F25C 1/12 62/352
(Continued)

FOREIGN PATENT DOCUMENTS

CN 114017963 A * 2/2022 ..... F25D 19/00
CN 116412571 A * 7/2023 ..... F25C 1/04
(Continued)

*Primary Examiner* — Jenna M Maroney
*Assistant Examiner* — Gustavo A Hincapie Serna
(74) *Attorney, Agent, or Firm* — LANWAY IPR SERVICES; Chun-Ming Shih

(57) ABSTRACT

An ice maker contains: a case in which an evaporator, a compressor, a condenser, a water tank, a storage box, and a feeding pump are accommodated. Multiple bullet-shaped molds are arranged on the evaporator and are inserted into the water tank, the storage box and the water tank are connected via a water supply tube, the feeding pump is fixed on the water supply tube, and the case includes an ice making mechanism. The ice making mechanism includes a circulation box, a water tube, and a water pump. The circulation box is disposed below the water tank and includes a mouth, such that a projection of a vertical direction of the water tank is located in the mouth of the circulation box, the water tube is connected between the circulation box and the water tank, and the water pump is mounted on the water tube.

10 Claims, 5 Drawing Sheets

(58) Field of Classification Search
CPC ..... F25C 1/25; F25C 1/20; F25C 1/18; F25C 2400/04; F25C 2400/12
See application file for complete search history.

(56) References Cited

U.S. PATENT DOCUMENTS 12,146,698 B1 * 11/2024 Zhang ..... F25C 5/142
2005/0016190 A1 * 1/2005 Wakatsuki ..... F25C 1/12 62/340
2008/0157644 A1 * 7/2008 Lee ..... F25C 5/22 62/344
2008/0216490 A1 * 9/2008 Wakatsuki ..... F25C 1/12 62/74
2008/0223069 A1 * 9/2008 Hsu ..... F25C 1/04 62/344
2009/0282855 A1 * 11/2009 Maples ..... F16K 31/26 62/320
2013/0167563 A1 * 7/2013 Lee ..... F25D 23/02 62/340
2015/0040587 A1 * 2/2015 Zisholtz ..... F25C 1/04 62/340
2020/0041190 A1 * 2/2020 Sakakibara ..... F25C 1/00
2020/0224949 A1 * 7/2020 Kandi ..... F25C 5/22
2020/0386469 A1 * 12/2020 Cha ..... F25D 17/065
2021/0148622 A1 * 5/2021 Hsu ..... C02F 1/4672
2022/0034570 A1 * 2/2022 Lee ..... F25C 1/045
2022/0412630 A1 * 12/2022 Mitchell ..... F25C 1/25
2023/0003431 A1 * 1/2023 Junge ..... F25C 1/18
2023/0375244 A1 * 11/2023 Chen ..... F25C 1/18
2024/0200845 A1 * 6/2024 Jiang ..... F25C 1/25
2024/0247854 A1 * 7/2024 Joo ..... F25C 1/20
2025/0052467 A1 * 2/2025 Foster ..... F25C 1/24
2025/0067490 A1 * 2/2025 Li ..... F25C 5/04
2025/0180266 A1 * 6/2025 Yan ..... F25C 1/147
2025/0207838 A1 * 6/2025 Seo ..... F25C 1/25
2025/0207839 A1 * 6/2025 Seo ..... F25C 1/25

FOREIGN PATENT DOCUMENTS

CN 220250379 U * 12/2023 ..... F25D 21/14
KR 20130021257 A * 3/2013 ..... F25C 1/18
KR 20170123138 A * 11/2017 ..... B01F 3/04787
KR 20230120431 A * 8/2023 ..... F25C 5/18
WO WO-2022073435 A1 * 4/2022 ..... F25C 5/185

* cited by examiner

ICE MAKER

TECHNICAL FIELD

The present disclosure relates to an ice maker, and more particularly to the ice maker which is capable of producing bullet-shaped ice cubes with a high transparency.

BACKGROUND

A conventional ice maker is used to make bullet-shaped ice cubes in cold drinks. When making these ice cubes, the mold on the evaporator is inserted into the water tank, and the ice water tank needs is filled with water fully, so the mold is soaked in water. Since the water in the water tank is stagnant and contains air, the ice cubes will appear white and opaque. Also, the ice cubes have low density, fast melting speed, low transparency, and poor aesthetics.

To solve this problem, the water in the water storage tank is continuously pumped to the ice making tank through a circulation water pump, so that the water in the ice making tank becomes living water, thus reducing bubbles in the water, and improving the transparency of bullet ice. However, the water in the water storage tank is normal temperature water, and the amount of water in the water storage tank is much larger than the amount of water in the ice making tank. Due to the water circulation formed between the water storage tank and the ice making tank, when making ice, the water in the water storage tank enters the ice making tank, it will heat the water in the ice making tank, thereby causing the ice making speed to be slow.

The present invention has arisen to mitigate and/or obviate the afore-described disadvantages.

SUMMARY

A primary aspect of the present invention is to provide an ice maker which is capable of enhancing transparency of the bullet-shaped ice cubes and cleanliness and reducing a supply of waters.

To obtain above-mentioned aspect, an ice maker provided by the present invention contains: a case in which an evaporator, a compressor, a condenser, a water tank, a storage box, and a feeding pump are accommodated. Multiple bullet-shaped molds are arranged on a bottom of the storage box and are inserted into the water tank, the storage box and the water tank are connected via a water supply tube, the feeding pump is fixed on the water supply tube, and the case includes an ice making mechanism. The ice making mechanism includes a circulation box, a water tube, and a water pump. The circulation box is disposed below the water tank and includes a mouth defined on a top thereof, such that a projection of a vertical direction of the water tank is located in the mouth of the circulation box, the water tube is connected between the circulation box and the water tank, and the water pump is mounted on the water tube.

When the ice maker makes the bullet-shaped ice cubes, the waters are pumped into the water tank from the storage box until the waters flow into the circulation box from the water tanks. After stopping the feeding pump and starting the water pump, the waters are pumped into the water tank from the circulation box via the water pump, and the waters are delivered into the circulation box from the water tank, thus supplying the waters repeatedly to decrease air bubbles and to enhance a transparency of the bullet-shaped ice cubes. When feeding the waters, the waters are fed into the circulation box in a small quantity by using the water pump, thus decreasing a supply of the waters and enhancing the production speed.

Other objects and features will be in part apparent and in part pointed out hereinafter.

DETAILED DESCRIPTION

Figure 1:
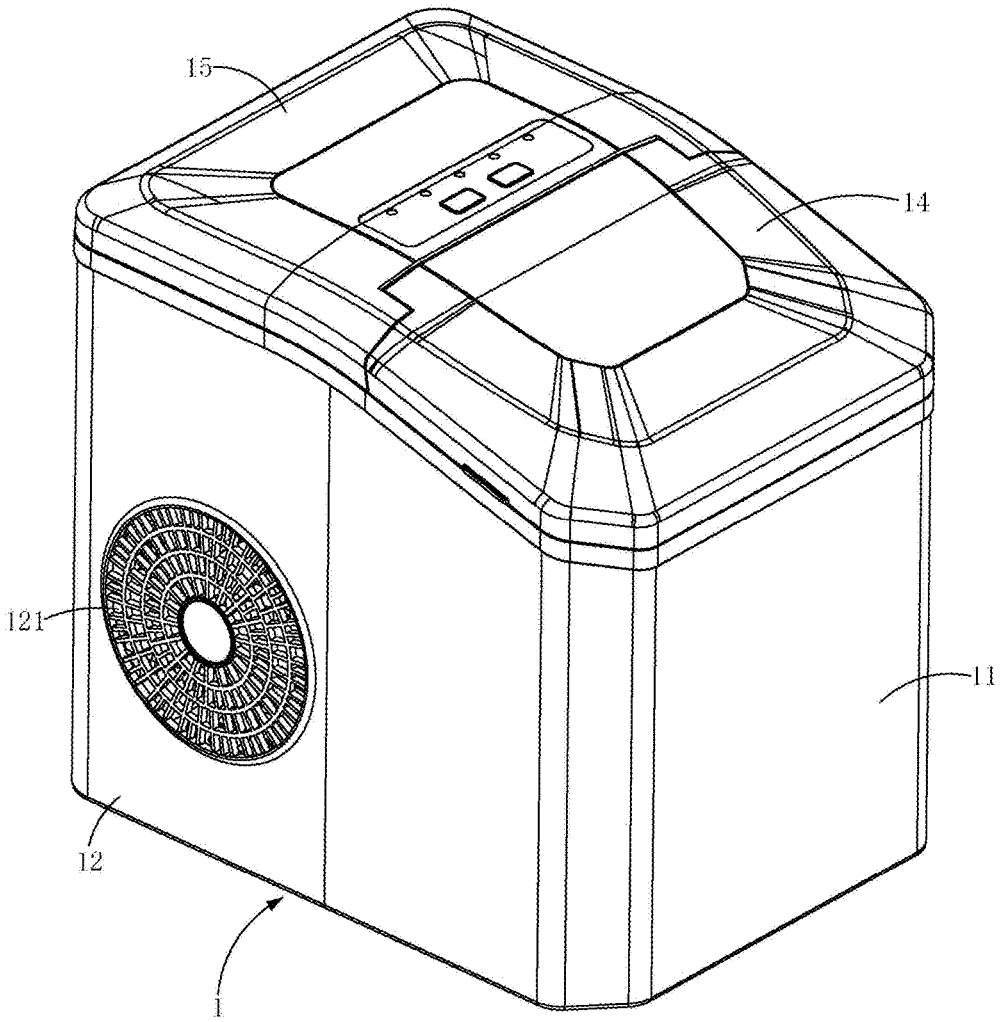
FIG. 1 is a perspective view showing the assembly of an ice maker according to a preferred embodiment of the present invention.
Figure 2:
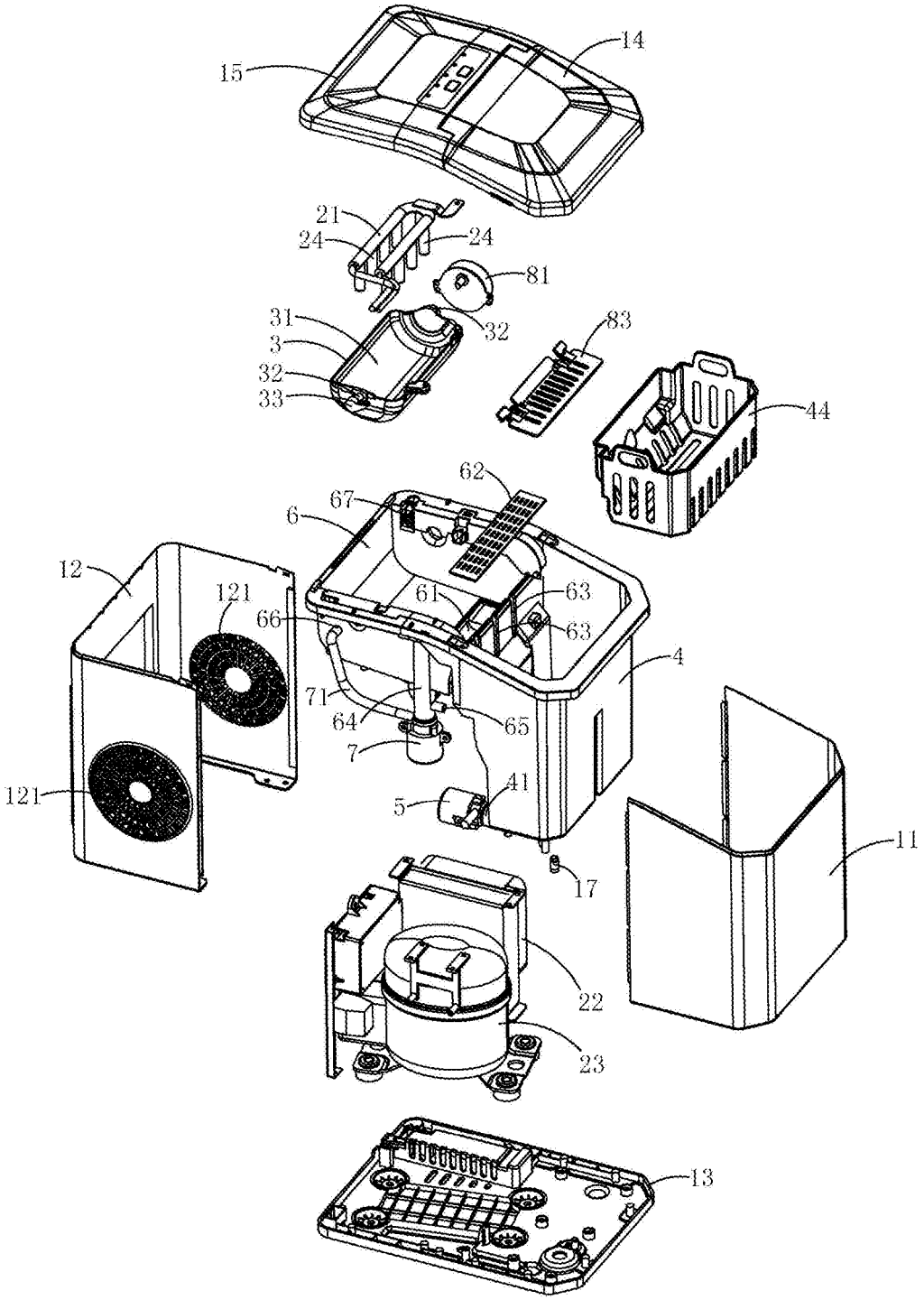
FIG. 2 is a perspective view showing the exploded components of the ice maker according to the preferred embodiment of the present invention.
Figure 3:
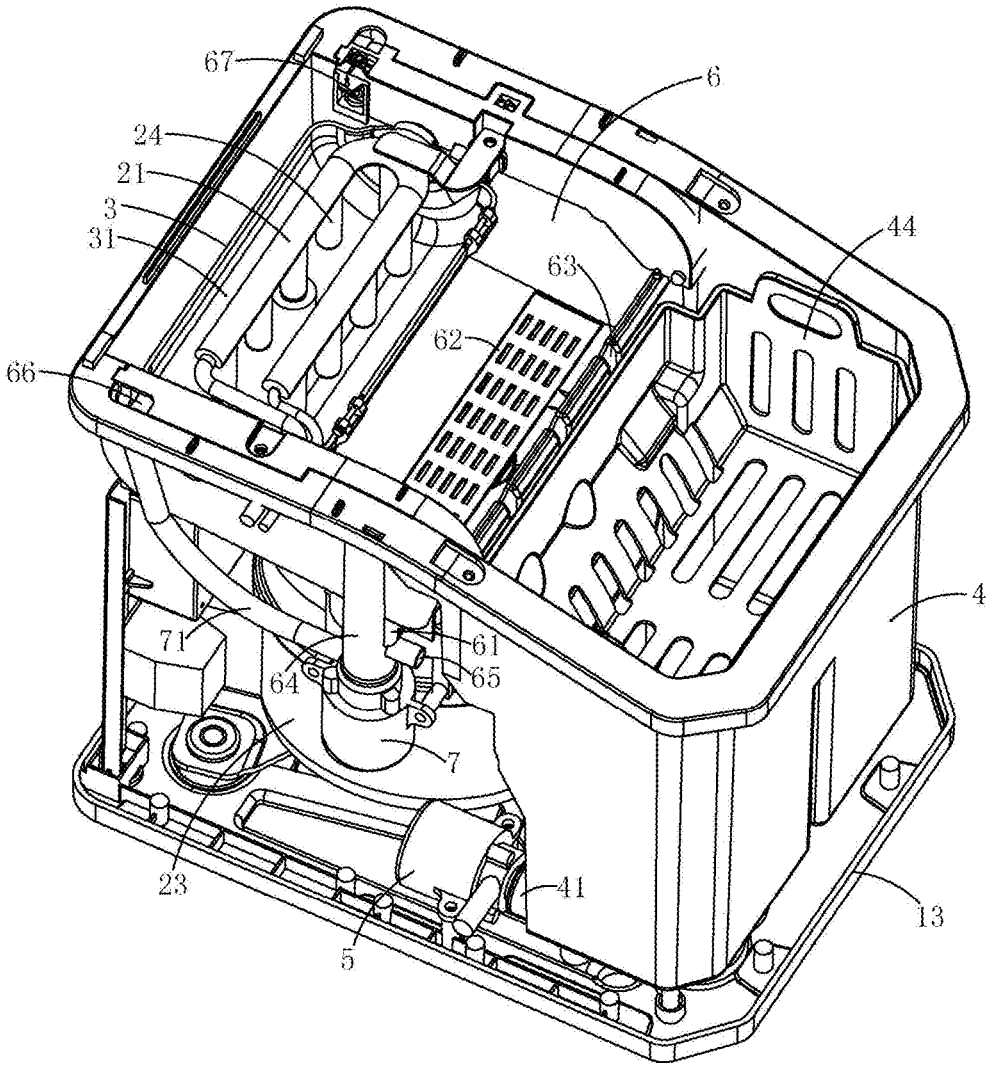
FIG. 3 is a perspective view showing the assembly of a part of the ice maker according to the preferred embodiment of the present invention.
Figure 4:
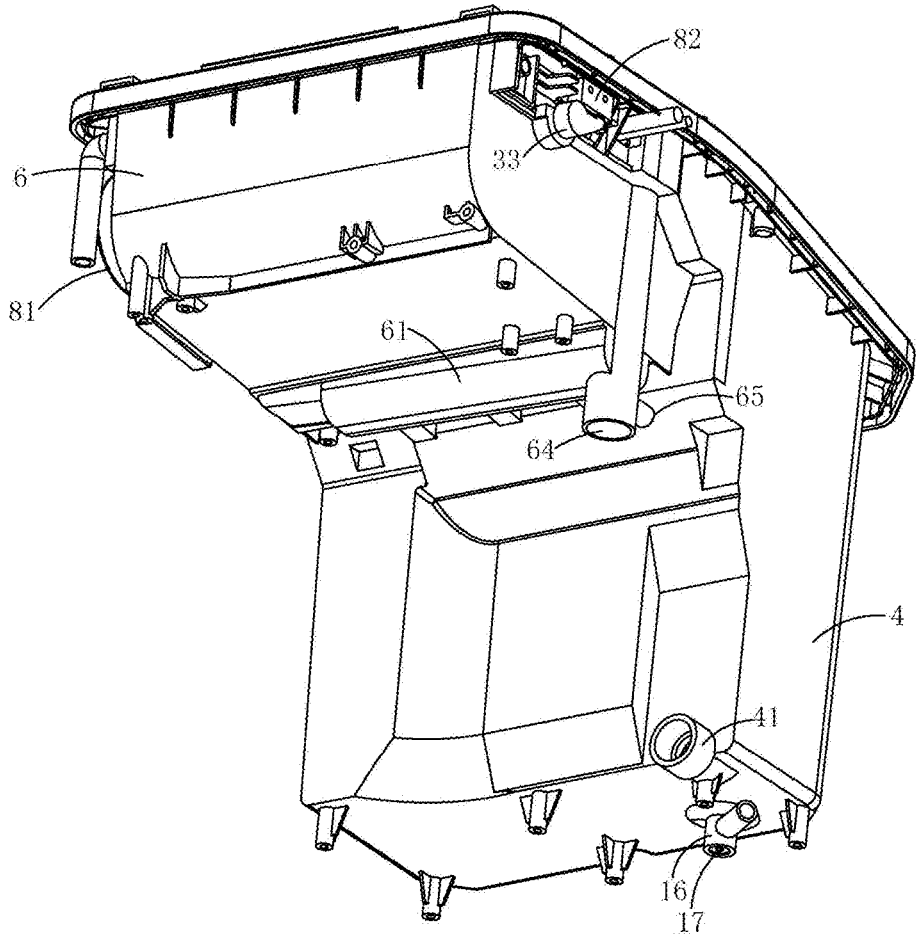
FIG. 4 is a perspective view showing the assembly of another part of the ice maker according to the preferred embodiment of the present invention.
Figure 5:
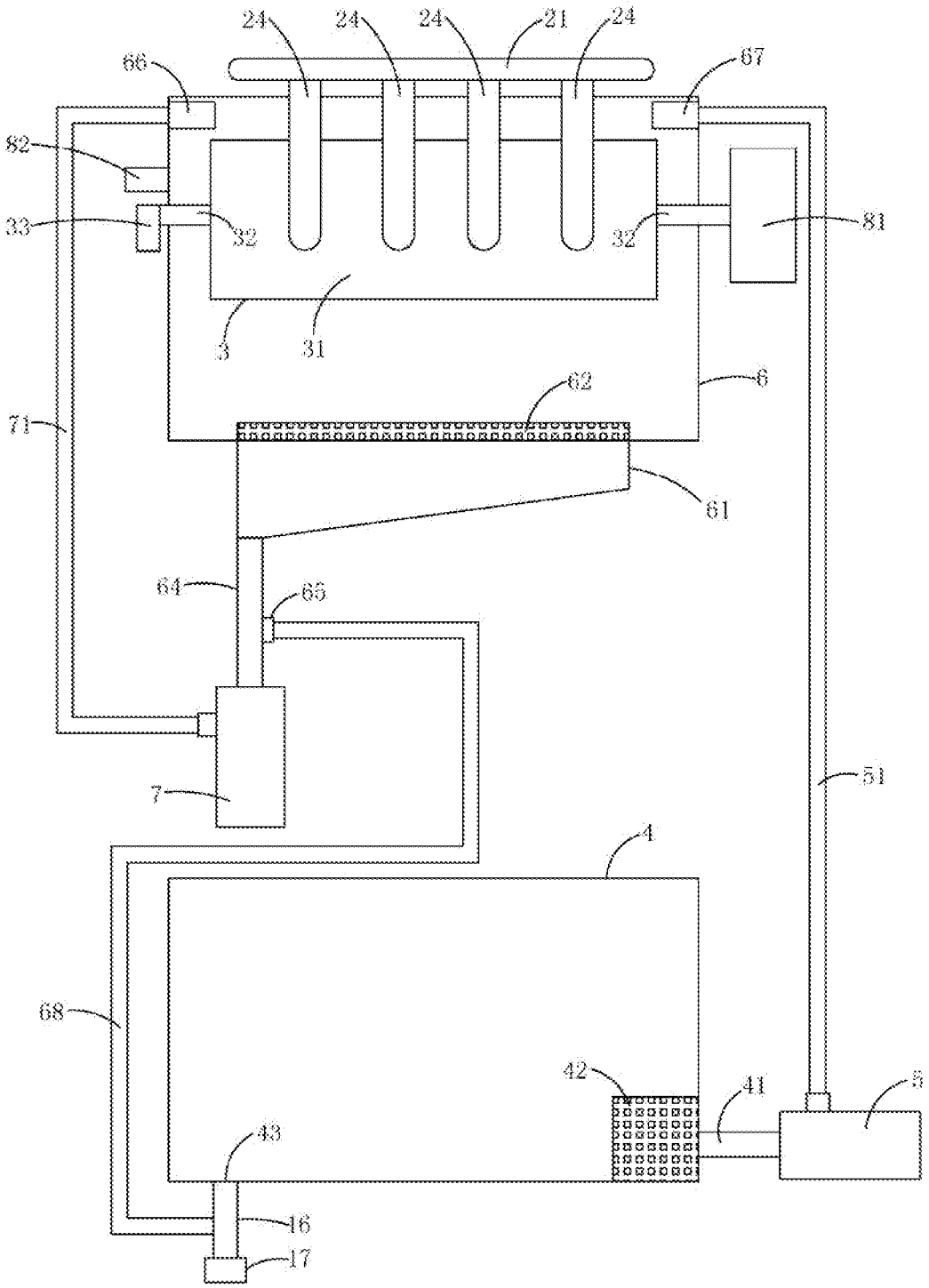
FIG. 5 is a schematic view showing the operation of the ice maker according to the preferred embodiment of the present invention.

With reference to FIGS. 1-5, an ice maker according to a preferred embodiment of the present invention comprises: a case 1 in which an evaporator 21, a compressor 23, a condenser 22, a water tank 31, a storage box 4, and a feeding pump 5 are accommodated, wherein multiple bullet-shaped molds 24 are arranged on a bottom of the evaporator 4 and are inserted into the water tank 31, the storage box 4 and the water tank 31 are connected via a water supply tube 51, the feeding pump 5 is fixed on the water supply tube 51, and the case 1 includes an ice making mechanism, wherein the ice making mechanism includes a circulation box 6, a water tube 71, and a water pump 7. The circulation box 6 is disposed below the water tank 31 and includes a mouth defined on a top thereof, such that a projection of a vertical direction of the water tank 31 is located in the mouth of the circulation box 6, the water tube 71 is connected between the circulation box 6 and the water tank 31, and the water pump 7 is mounted on the water tube 71.

The conventional ice maker produces ice cubes with a poor transparency, and a part of waters in the storage box 4 is pumped into the water tank 31 in a large quantity to cause a slow production speed. However, when the ice maker of the present invention makes ice cubes, the waters are pumped into the water tank 31 from the storage box 4 until the waters flow into the circulation box 6 from the water tanks 31. After stopping the feeding pump 5 and starting the water pump 7, the waters are pumped into the water tank 31 from the circulation box 6 via the water pump 7, and the waters are delivered into the circulation box 6 from the water tank 31, thus supplying the waters repeatedly to decrease air bubbles and to enhance a transparency of the bullet-shaped ice cubes. When feeding the waters, the waters are fed into the circulation box 6 in a small quantity by using the water pump 7, thus decreasing a supply of the waters and enhancing the production speed.

The water tank 31 has a first inlet 66 and a second inlet 67 defined on two sides thereof, the circulation box 6 includes a filtration mesh 62 received therein, and the circulation box 6 includes a first outlet defined on a bottom thereof. An end of the water tube 71 is connected with the first outlet of the circulation box 6, and the other end of the water tube 71 is connected with the first inlet 66, wherein the storage box 4 includes a second outlet defined on a bottom thereof, an end of a supply tube 51 is connected with the second outlet of the storage box 4, and the other end of the supply tube 51 is connected with the second inlet 67. The filtration mesh 62 is configured to filter the waters to enhance a cleanliness of the ice maker and to avoid impurities or the bullet-shaped ice cubes moving into the water pump 7, thus enhancing a supply stability of the bullet-shaped ice cubes.

The circulation box 6 includes a filtering tank 61 extending downward from the bottom thereof and covered by the filtration mesh 62, wherein the first outlet of the circulation box 6 is defined on a bottom of the filtration mesh 62. The feeding pump 5 is configured to pump the waters into the water tank 31 from the storage box 4 until the waters flow into the circulation box 6 from the water tank 31, and the waters further flow into the filtering tank 61 from the circulation box 6 via the filtration mesh 62, wherein the feeding pump 5 is configured to pump the waters in a predetermined quantity by using a measurement pump, and the predetermined quantity of the feeding pump 5 is equal to a volume of the water tank 31 and is not higher than a volume of the filtering tank 61. Alternatively, the filtering tank 61 is provided with a water level sensor disposed on a top thereof so that the water level sensor senses a stop level to stop the feeding pump 5, hence a water consumption of the ice maker is controlled. When stopping making the bullet-shaped ice cubes, a water level of the circulation box 6 is located in the filtering tank 61 and below the filtration mesh 62, thus avoiding mosquito breeding to enhance the cleanliness of the ice maker.

The circulation box 6 includes multiple connection tanks 63 separately arranged on a front end thereof and communicating with the storage box 4, wherein a bottom of a respective one connection tank 63 extends to a top of the filtering tank 61. A depth of a first end of the filtering tank 61 is less than a depth of a second end of the filtering tank 61, and a bottom of the filtering tank 61 has a slope, the first outlet of the circulation box 6 is defined on the second end of the filtering tank 61. When the feeding pump 5 feeds the waters in a predetermined quantity, the waters flow back to the storage box 4 from an exterior of the filtering tank 61 via the multiple connection tanks 63, thus feeding the waters in the predetermined quantity. Thereby, the waters flow out of the first outlet by using the slop of the bottom of the filtering tank 61 to avoid an accumulation of the waters in the filtering tank 61.

The first outlet is connected with a water tube 64, an inlet segment of the water pump 7 is fixed on an end of a receiving tube, and an outlet segment of the water pump 7 is connected with the water tube 71. The second outlet is connected with a feeding tube 41, an inlet segment of the feeding pump 5 is disposed on an end of a feeding tube 41, an inlet segment of the feeding pump 5 is connected on an end of the feeding tube 41, and an outlet segment of the feeding pump 5 is mounted on an end of the feeding tube 41, wherein an outlet segment of the feeding pump 5 is coupled with the supply tube 51. The feeding tube 41 has a filtering cap 42 received therein and located in the storage box 4, such that the filtering cap 42 is configured to filter the impurities and the bullet-shaped ice cubes in the storage box 4 to avoid the impurities and the bullet-shaped ice cubes moving into the feeding pump 5. The water pump 7 is connected on the water tube 64, the feeding pump 5 is connected on the feeding tube 41, wherein the water tube 64 and the feeding tube 41 are made of hard plastic and formed on the circulation box 6 and the storage box 4, thus reinforcing the water pump 7 and the feeding pump 5 by way of the water tube 71 and the feeding tube 41 to reduce a vibration, noises, and a length of the water tube 71 and the supply tube 51.

The watering tube 64 has a first discharge orifice 65 defined on an outer wall thereof, the storage box 4 has a second discharge orifice 43 formed on the bottom thereof, and the case 1 includes a discharge tube 16, wherein an end of the discharge tube 16 is formed on the bottom of the storage box 4, and the other end of the discharge tube 16 extends out of the case 1, wherein the first discharge orifice 65 is connected with the discharge tube 16 via a connection tube 68, the discharge tube 16 has a seal element 17 fixed thereon so that the seal element 17 is removed to discharge the waters out of the circulation box 6 and the storage box 4, thus cleaning the circulation box 6 and the storage box 4. The second discharge orifice 43 is connected with the discharge tube 16 via the connection tube 68, and the discharge tube 16 has an electromagnetic valve disposed thereon and configured to discharge the waters out of the circulation box 6 and the storage box 4 automatically.

The case 1 further includes a receiving chamber defined therein and configured to accommodate the storage box 4 and the circulation box 6 behind the storage box 4, wherein a rear end of the storage box 4 is one-piece formed with a front end of the circulation box 6, and the compressor 23, the condenser 22, the water pump 7 and the feeding pump 5 are located on the bottom of the circulation box 6, wherein the circulation box 6 has a disc 3 fixed in the top thereof and having the water tank 31, wherein the first inlet 66 and the second inlet 67 are defined on two sides of the circulation box 6 and face the water tank 31, wherein a rear end of the storage box 4 is one-piece formed with a front end of the circulation box 6 to reduce simplify a structure, a fabrication cost, and a size.

The disc 3 has two rotary posts 32 extending from two sides thereof and rotatably connected in the circulation box 6, and the circulation box 6 has a drive motor 81 and a switch 82 fixed on an outer wall thereof, wherein a rotary post is connected with the drive motor 81, and the other rotary post has a trigger element 33 configured to mate with the switch 82. After making the bullet-shaped ice cubes, the drive motor 81 drives the disc 3 to rotate so as to remove the bullet-shaped ice cubes from the water tank 31 automatically. When the disc 3 rotates back to an original position, the trigger element 33 abuts against and drives the switch 82 so as to detect whether the disc 3 is rotated back to the original position, thus producing the bullet-shaped ice cubes again automatically.

The disc 3 has a holding tray 83 rotatably connected on a front end thereof, the storage box 4 accommodates a bucket 44. The waters are fed into a lower end of the storage box 4, and an upper end of the storage box 4 accommodates the bullet-shaped ice cubes by using the bucket 44, thus reducing a size of the storage box 4. After producing the bullet-shaped ice cubes, the drive motor 81 drives the disc 3 to rotate 90 degrees backward so as to remove the bullet-shaped ice cubes on the holding tray 83 from the receiving groove 31. After the disc 3 is rotated back to the original position, the holding tray 83 is move forward and rotated downward to pour the bullet-shaped ice cubes into the bucket 44 exactly and stably.

The case 1 includes a front part 11, a rear part 12, a bottom part 13, and a front lid 14, and a rear lid 15, wherein a rear end of the front part 11 is connected with a front end of the rear part 12, a bottom of the front part 11 and a bottom of the rear part 12 are fixed on a top of the bottom part 13, a top of the front part 11 is connected with a top of the storage box 4, a top of the rear part 12 is connected with the top of the circulation box 6, wherein the rear lid 15 is covered on the circulation box 6, a rear end of the front lid 14 is rotatably connected with a front end of the front lid 15 and covered on the storage box 4. The rear part 12 has two heat dissipation windows 121 fixed on two sides thereof, wherein each heat dissipation window 121 has a fan. The front part 11, the rear part 12, the bottom part 13, the top lid 14 and the rear lid 15 of the case 1 are removably connected to facilitate a production and a maintenance. A printed circuit board (PCB) is received in the rear lid 15 to avoid contacting with the waters, and a heat is dissipated from each heat dissipation window 121 by using the fan, thus removing the heat efficiently.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An ice maker comprising: a case 1 in which an evaporator 21, a compressor 23, a condenser 22, a water tank 31, a storage box 4, and a feeding pump 5 are accommodated, wherein multiple bullet-shaped molds 24 are arranged on a bottom of the storage box 4 and are inserted into the water tank 31, the evaporator 21 and the water tank 31 are connected via a water supply tube 51, the feeding pump 5 is fixed on the water supply tube 51, and the case 1 includes an ice making mechanism, wherein the ice making mechanism includes a circulation box 6, a water tube 71, and a water pump 7; the circulation box 6 is disposed below the water tank 31 and includes a mouth defined on a top thereof, such that a projection of a vertical direction of the water tank 31 is located in the mouth of the circulation box 6, the water tube 71 is connected between the circulation box 6 and the water tank 31, and the water pump 7 is mounted on the water tube 71.

2. The ice maker as claimed in claim 1, wherein the water tank 31 has a first inlet 66 and a second inlet 67 defined on two sides thereof, the circulation box 6 includes a filtration mesh 62 received therein, and the circulation box 6 includes a first outlet defined on a bottom thereof; an end of the water tube 71 is connected with the first outlet of the circulation box 6, and the other end of the water tube 71 is connected with the first inlet 66, wherein the storage box 4 includes a second outlet defined on a bottom thereof, an end of the supply tube 51 is connected with the second outlet of the storage box 4, and the other end of the supply tube 51 is connected with the second inlet 67.

3. The ice maker as claimed in claim 2, wherein the circulation box 6 includes a filtering tank 61 extending downward from the bottom thereof and covered by the filtration mesh 62, and the first outlet of the circulation box 6 is defined on a bottom of the filtration mesh 62.

4. The ice maker as claimed in claim 3, wherein the circulation box 6 includes multiple connection tanks 63 separately arranged on a front end thereof and communicating with the storage box 4, and a bottom of a respective one connection tank 63 extends to a top of the filtering tank 61;

wherein a depth of a first end of the filtering tank 61 is less than a depth of a second end of the filtering tank 61, a bottom of the filtering tank 61 has a slope, and the first outlet of the circulation box 6 is defined on the second end of the filtering tank 61.

5. The ice maker as claimed in claim 4, wherein the first outlet is connected with the water tube 64, an inlet segment of the water pump 7 is fixed on an end of a receiving tube, and an outlet segment of the water pump 7 is connected with the water tube 71;

wherein the second outlet is connected with a feeding tube 41, an inlet segment of the feeding pump 5 is connected on an end of a flowing tube 41, wherein an inlet segment of the feeding pump 5 is connected on an end of the feeding tube 41, wherein an outlet segment of the feeding pump 5 is coupled with the supply tube 51, and the feeding tube 41 has a filtering cap 42 received therein and located in the storage box 4.

6. The ice maker as claimed in claim 5, wherein the watering tube 64 has a first discharge orifice 65 defined on an outer wall thereof, the storage box 4 has a second discharge orifice 43 formed on the bottom thereof, and the case 1 includes a discharge tube 16, wherein the first discharge orifice 65 and the second discharge orifice 43 are connected with the discharge tube 16 via a connection tube 68, and the discharge tube 16 has a seal element 17 or an electromagnetic valve fixed thereon.

7. The ice maker as claimed in claim 2, wherein the case 1 further includes a receiving chamber defined therein and configured to accommodate the storage box 4 and the circulation box 6 behind the storage box 4, wherein a rear end of the storage box 4 is one-piece formed with a front end of the circulation box 6, and the compressor 23, the condenser 22, the water pump 7 and the feeding pump 5 are located on the bottom of the circulation box 6, wherein the circulation box 6 has a disc 3 fixed in the top thereof and having the water tank 31, and the first inlet 66 and the second inlet 67 are defined on two sides of the circulation box 6 and face the water tank 31.

8. The ice maker as claimed in claim 7, wherein the disc 3 has two rotary posts 32 extending from two sides thereof and rotatably connected in the circulation box 6, and the circulation box 6 has a drive motor 81 and a switch 82 fixed on an outer wall thereof, wherein a rotary post is connected with the drive motor 81, and the other rotary post has a trigger element 33 configured to mate with the switch 82.

9. The ice maker as claimed in claim 8, wherein the disc 3 has a holding tray 83 rotatably connected on a front end thereof, and the storage box 4 accommodates a bucket 44.

10. The ice maker as claimed in claim 9, wherein the case 1 includes a front part 11, a rear part 12, a bottom part 13, and a front lid 14, and a rear lid 15, wherein a rear end of the front part 11 is connected with a front end of the rear part 12, a bottom of the front part 11 and a bottom of the rear part 12 are fixed on a top of the bottom part 13, a top of the front part 11 is connected with a top of the storage box 4, and a top of the rear part 12 is connected with the top of the circulation box 6, wherein the rear lid 15 is covered on the circulation box 6, and a rear end of the front lid 14 is rotatably connected with a front end of the front lid 15 and covered on the storage box 4;

wherein the rear part 12 has two heat dissipation windows 121 fixed on two sides thereof, and each heat dissipation window 121 has a fan.

* * * * *